US011565909B2

(12) United States Patent
Gou

(10) Patent No.: US 11,565,909 B2
(45) Date of Patent: Jan. 31, 2023

(54) STABILIZING DEVICE OF ELEVATOR CAR AND AN ELEVATOR SYSTEM

(71) Applicant: Otis Elevator Company, Farmington, CT (US)

(72) Inventor: Xingang Gou, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 106 days.

(21) Appl. No.: 17/086,962

(22) Filed: Nov. 2, 2020

(65) Prior Publication Data

US 2021/0130125 A1 May 6, 2021

(30) Foreign Application Priority Data

Nov. 6, 2019 (CN) ..... 201911076236.2

(51) Int. Cl.

| | |
|---|---|
| ***B66B 1/36*** | (2006.01) |
| ***B66B 9/00*** | (2006.01) |
| *B66B 5/18* | (2006.01) |
| *B66B 17/34* | (2006.01) |

(52) U.S. Cl.

CPC ..... *B66B 1/36* (2013.01); *B66B 5/18* (2013.01); *B66B 9/00* (2013.01); *B66B 17/34* (2013.01)

(58) Field of Classification Search

CPC ..... B66B 1/36; B66B 5/18; B66B 17/34

See application file for complete search history.

(56) References Cited

U.S. PATENT DOCUMENTS

| | | | | |
|---|---|---|---|---|
| 5,096,020 | A * | 3/1992 | Korhonen | B66B 5/22 188/43 |
| 8,186,483 | B2 * | 5/2012 | Sirigu | B66B 5/22 187/373 |
| 9,457,989 | B2 * | 10/2016 | Meierhans | B66B 5/20 |
| 2008/0128218 | A1 * | 6/2008 | Gremaud | B66B 5/22 187/250 |
| 2018/0194595 | A1 * | 7/2018 | Li | B66B 1/32 |
| 2019/0248627 | A1 * | 8/2019 | Munoz | F16D 63/002 |

FOREIGN PATENT DOCUMENTS

| | | | | |
|---|---|---|---|---|
| CN | 113830643 | A * | 12/2021 | B66B 1/32 |
| WO | WO-2014077811 | A1 * | 5/2014 | B66B 5/18 |
| WO | WO-2015055539 | A1 * | 4/2015 | B66B 5/18 |

* cited by examiner

*Primary Examiner* — Diem M Tran

(74) *Attorney, Agent, or Firm* — Cantor Colburn LLP

(57) ABSTRACT

A stabilizing device of an elevator car and an elevator system. The stabilizing device include a first frame body, a second frame body, a left electromagnetic block, a right electromagnetic block, a left damper and a right damper, wherein the left electromagnetic block and the right electromagnetic block are mounted within the second frame body in a limiting manner in an up-down direction and are moveable in a left-right direction, and the left damper and the right damper are arranged in the up-down direction. The fixed end of the left damper and the fixed end of the right damper are mounted within the second frame body in a limiting manner in the up-down direction, and the movable ends of the left damper and the right damper are connected to the first frame body and are moveable upwardly and downwardly together with the first frame body.

17 Claims, 5 Drawing Sheets

STABILIZING DEVICE OF ELEVATOR CAR AND AN ELEVATOR SYSTEM

FOREIGN PRIORITY

This application claims priority to Chinese Patent Application No. 201911076236.2, filed Nov. 6, 2019, and all the benefits accruing therefrom under 35 U.S.C. § 119, the contents of which in its entirety are herein incorporated by reference.

TECHNICAL FIELD OF INVENTION

The invention pertains to the technical field of elevators, and relates to a stabilizing device of an elevator car and an elevator system using the stabilizing device.

BACKGROUND OF THE INVENTION

An elevator car of an elevator system is dragged or suspended by using a traction medium such as a steel rope or a steel belt. Especially, when stopping at a particular floor to load/unload passengers or goods, the elevator car is suspended by the steel rope or steel belt and stops in a hoistway to facilitate loading or unloading.

However, the traction medium such as the steel rope or steel belt is more or less elastic. If the weight of the elevator car significantly changes during loading or unloading, the elevator car is likely to vibrate in the up-down direction or sink/float in a large amount, especially when the steel rope or steel belt is relatively long. Such vibration or sinking/floating causes the elevator car to be unstable when it stops at a particular floor and leads to poor passenger experience.

SUMMARY OF THE INVENTION

The following technical solutions are provided by the present disclosure to effectively solve or at least alleviate one or more of the above problems in the prior art and the problems of other aspects.

According to an aspect of the present disclosure, a stabilizing device is provided and comprises:

a first frame body fixedly mounted relative to the elevator car; a second frame body positioned and mounted within the first frame body, wherein the first frame body and the second frame body are moveable upwardly and downwardly relative to each other; a left electromagnetic block and a right electromagnetic block, which are installed in the second frame body in a limiting manner in an up-down direction, for clamping a guide rail and generating friction force for preventing the second frame body from moving up and down relative to the clamped guide rail; and a left damper and a right damper arranged along the up-down direction, whose fixed ends are mounted within the second frame body in a limiting manner in the up-down direction, and whose movable ends are connected to the first frame body and moveable upwardly and downwardly together with the first frame body under the condition that the guide rail is clamped by the left electromagnetic block and the right electromagnetic block, so as to reduce movement of the elevator car in the up-down direction.

The stabilizing device according to another embodiment of the present disclosure, wherein the left electromagnetic block and the right electromagnetic block are arranged in a left-right symmetrical manner along a central plane of the stabilizing device, and the left damper and the right damper are arranged in a left-right symmetrical manner along the central plane of the stabilizing device.

The stabilizing device according to another embodiment or any of the preceding embodiments of the present disclosure, further includes: a left horizontal actuating member for pushing the left electromagnetic block towards the guide rail; and a right horizontal actuating member for pushing the right electromagnetic block towards the guide rail; wherein the left horizontal actuating member and the right horizontal actuating member are mounted within the second frame body.

The stabilizing device according to another embodiment or any of the preceding embodiments of the present disclosure, wherein the left horizontal actuating member and the right horizontal actuating member are arranged in a left-right symmetrical manner along a central plane of the stabilizing device.

The stabilizing device according to another embodiment or any of the preceding embodiments of the present disclosure, further includes a control portion configured to: firstly control, when the elevator car stops moving, the left horizontal actuating member and the right horizontal actuating member to push the left electromagnetic block and the right electromagnetic block, respectively, to get close to the guide rail; and then control, when both the left electromagnetic block and the right electromagnetic block substantially contact with the guide rail, the left electromagnetic block and the right electromagnetic block to be energized to clamp the guide rail.

The stabilizing device according to another embodiment or any of the preceding embodiments of the present disclosure, further includes: a left horizontal reset component for resetting the left electromagnetic block clamping the guide rail away from the guide rail; and a right horizontal reset component for resetting the right electromagnetic block clamping the guide rail away from the guide rail.

The stabilizing device according to another embodiment or any of the preceding embodiments of the present disclosure, wherein the left horizontal actuating member/the right horizontal actuating member comprises a horizontally disposed leading screw and a motor for driving the leading screw; wherein two ends of the leading screw are connected with the inner side face of the second frame body and the left electromagnetic block/the right electromagnetic block respectively, and the left horizontal reset component/the right horizontal reset component is a spring sleeved on the leading screw.

The stabilizing device according to another embodiment or any of the preceding embodiments of the present disclosure, wherein the left electromagnetic block and the right electromagnetic block are capable of sliding left and right on a guide rail provided inside the second frame body.

The stabilizing device according to another embodiment or any of the preceding embodiments of the present disclosure, wherein the upper and lower ends of the left electromagnetic block/the right electromagnetic block abut against the upper and lower inner side faces of the second frame body, respectively.

The stabilizing device according to another embodiment or any of the preceding embodiments of the present disclosure, further includes: a left vertical reset component and a right vertical reset component for resetting the second frame body relative to the first frame body in the up-down direction.

The stabilizing device according to another embodiment or any of the preceding embodiments of the present disclosure, wherein the left damper/the right damper is a hydraulic buffer, an oil cylinder of the hydraulic buffer corresponds to the fixed end, and a piston rod of the hydraulic buffer corresponds to the movable end.

The stabilizing device according to another embodiment or any of the preceding embodiments of the present disclosure, wherein the left vertical reset component/the right vertical reset component is a spring sleeved on the piston rod.

The stabilizing device according to another embodiment or any of the preceding embodiments of the present disclosure, wherein the second frame body is mounted within the first frame body in a limiting manner in a horizontal direction by means of a horizontal fixture; and, when the elevator car moves in the up-down direction, the second frame body is moveable upwardly and downwardly relative to the first frame body by taking the horizontal fixture as a guide component.

The stabilizing device according to another embodiment or any of the preceding embodiments of the present disclosure, further includes a third vertical reset component for resetting the second frame body relative to the first frame body in the up-down direction.

The stabilizing device according to another embodiment or any of the preceding embodiments of the present disclosure, wherein the second frame body is approximately a square frame structure.

The stabilizing device according to another embodiment or any of the preceding embodiments of the present disclosure, wherein the first frame body is approximately a square frame structure and the second frame body is nested in an inner cavity of the first frame body.

According to another aspect of the present disclosure, an elevator system is provided and includes a traction medium, an elevator car and a guide rail, further includes anyone of preceding stabilizing devices.

The above features and operations of the present invention will become more obvious from the following descriptions and drawings.

BRIEF DESCRIPTION OF THE DRAWINGS

The above and other objects and advantages of the present invention will become clearer and more complete from the following detailed descriptions given in conjunction with the drawings, wherein the same or similar elements are denoted by the same reference sign.

DETAILED DESCRIPTION OF THE INVENTION

The present invention is now described more thoroughly with reference to the accompanying drawings. The drawings show exemplary embodiments of the present invention. However, the present invention may be implemented according to a lot of different forms, and should not be construed as being limited by the embodiments illustrated herein. On the contrary, these embodiments are provided to make the present disclosure thorough and complete, and fully convey the idea of the present invention to those skilled in the art.

In the following description, to make the description clear and concise, not all parts shown in the figures are described in detail. Multiple parts that can fully implement the present invention are shown in the accompanying drawings for those of ordinary skill in the art. For those skilled in the art, operations of many parts are familiar and apparent.

In the following description, for convenience of explanation, a direction of a guide rail corresponding to an elevator system is defined as a z-direction, a direction perpendicular to a clamping surface of the guide rail is defined as a x-direction, and a direction perpendicular to the z-direction and the x-direction is defined as an y-direction. It should be understood that the definitions of these directions are used for relative description and clarification, and may change correspondingly according to changes in the orientation of the stabilizing device.

In the following examples, the orientation terms "upper" and "lower" are defined based on the z-direction, the "left" and "right" direction terms are defined based on the x-direction, and the "front" and "back" direction terms are defined based on the y-direction; also, it is to be understood that these directional terms are relative concepts and are used for relative description and clarification, which may vary accordingly depending on the orientation in which the stabilizing device is mounted.

Where used, the terms "first", "second" and the like do not necessarily denote any order or priority relationship, but may be used to more clearly distinguish elements or object intervals from one another.

The stabilizing device 100 of an elevator car of an embodiment of the present invention and the elevator system 10 using the stabilizing device 100 are exemplified in detail below in connection with FIGS. 1-5.

Figure 5:
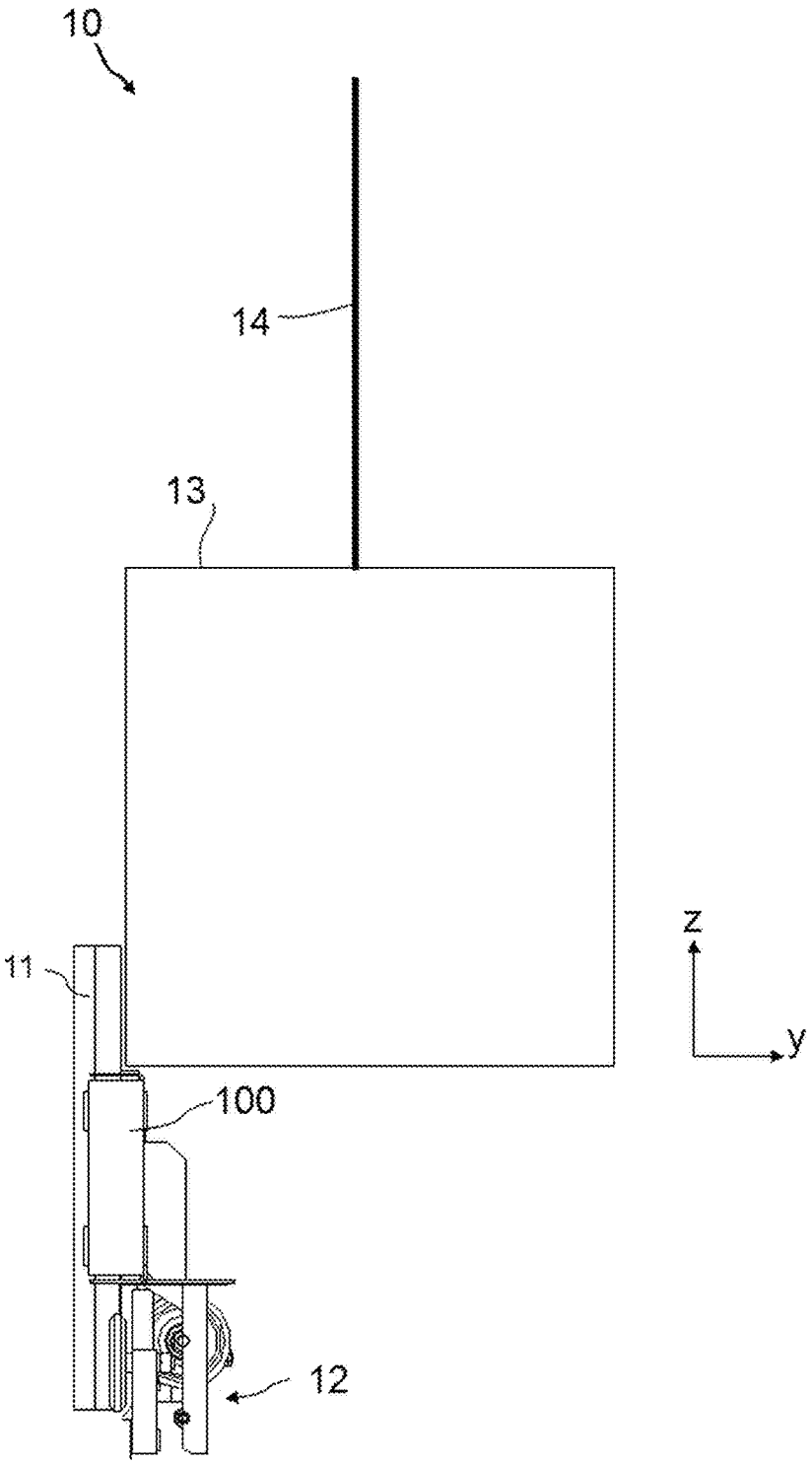
FIG. 5 is front view of elevator system installed with the stabilizing device of embodiment shown in FIG. 1 according to an embodiment of present invention.

As shown in FIG. 5, in the elevator system 10 of an embodiment, the elevator car 13 is dragged by a traction medium (e.g., steel belt 14). If the elevator car 13 is loaded/unloaded (e.g., when passengers get on or off, etc.), a change in the weight of the elevator car 13 that has stopped or landed will cause a certain amount of elastic deformation of the steel belt 14; given that the elastic deformation of the steel belt 14 is relatively large, a more pronounced movement in the z-direction will occur. The movement may in particular be vibration, may in particular be shown as sinking, or may in particular be manifested as floating.

The stabilizing device 100 is fixedly mounted directly or indirectly with respect to the elevator car 13 of the elevator system 10; thus, the vibration action of the elevator car 13 in the z-direction will be transmitted to the stabilizing device 100. The stabilizing device 100 is mainly used to reduce the movement (e.g. vibration, sinking or floating) of the elevator car 13 in the up-down direction, for example, to prevent the up-down movement of the elevator car 13 in the z-direction when the elevator car 13 is parked at a landing of a certain floor (e.g., when a landing door of the landing is open), thereby improving the experience of passengers within the elevator car 13. As shown particularly in FIG. 5, the stabilizing device 100 may be mounted on one or more guide shoes 12 of the elevator car 13, which may be mounted on an upper guide shoe or a lower guide shoe, or on both the upper guide shoe and the lower guide shoe. It will be appreciated that the installation may be chosen in particular according to a principle that normal operation of the elevator car 13 in the hoistway is not affected; for example, the stabilizing device 100 even may be mounted on other components of the elevator car 13 other than the guide shoes 12.

Figure 1:
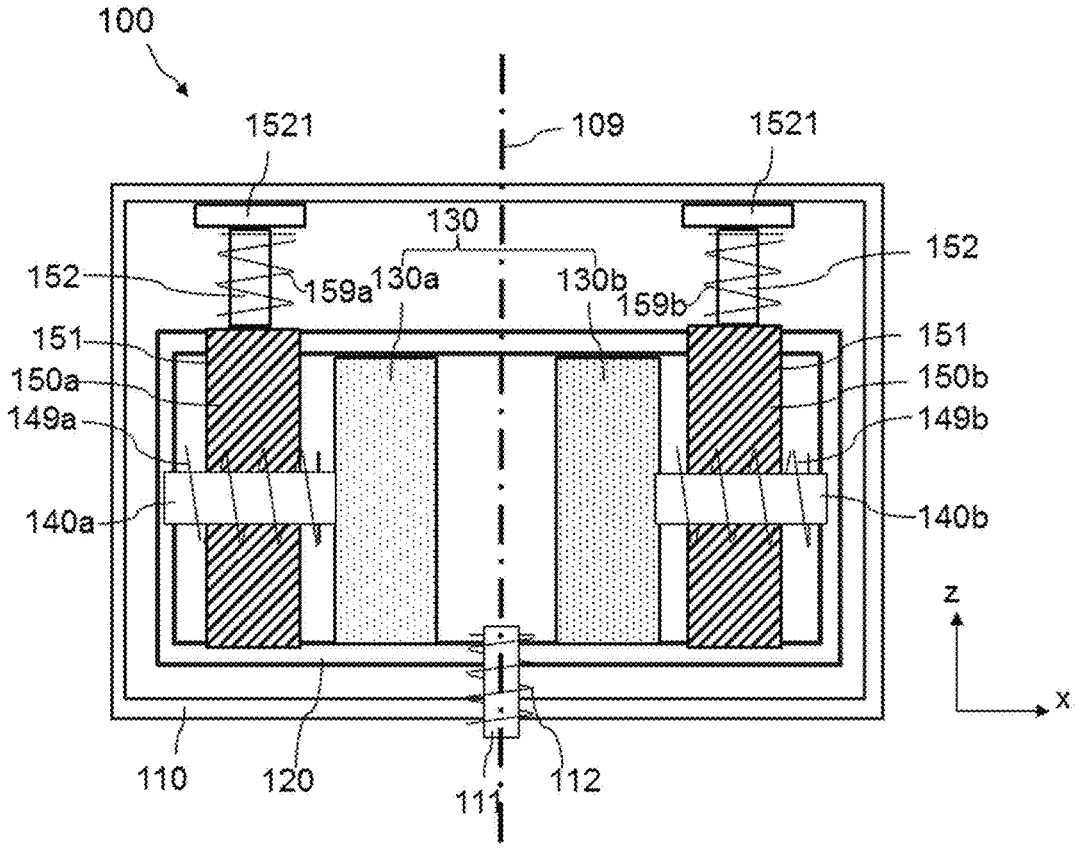
FIG. 1 is a front view of a stabilizing device of an elevator car according to a first embodiment of the present invention.
Figure 2:
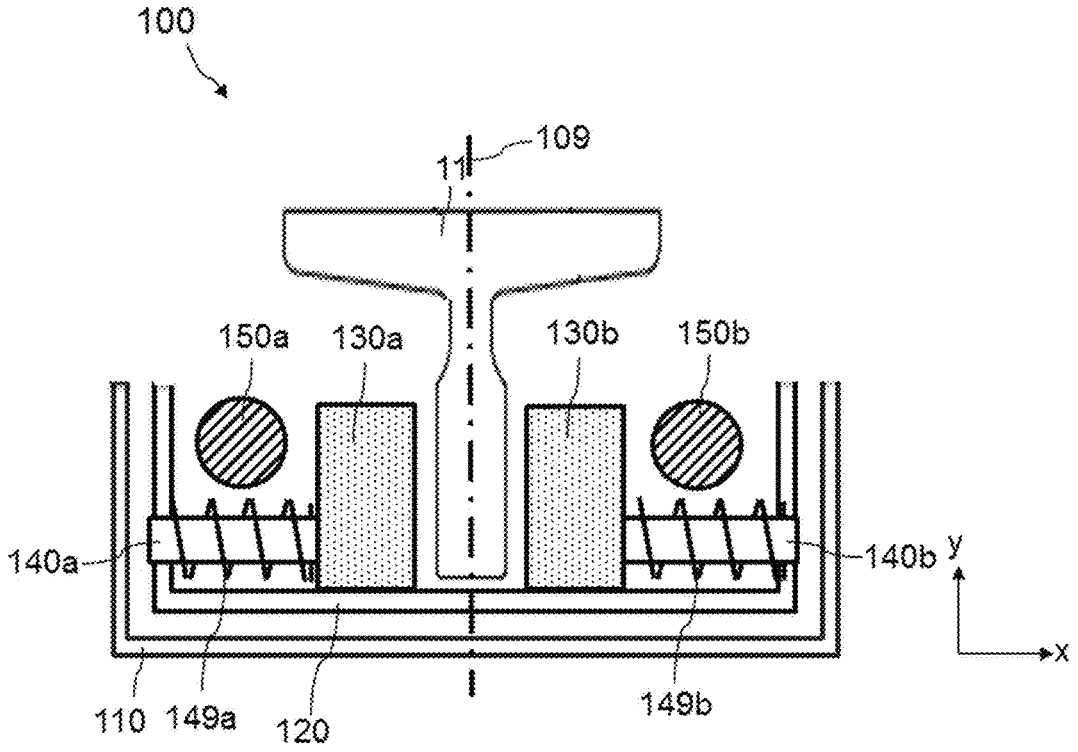
FIG. 2 is a horizontal cross-sectional view of the stabilizing device of an elevator car in accordance with a first embodiment of the present invention.

As shown in FIGS. 1 and 2, the stabilizing device 100 includes a first frame body 110 and a second frame body 120, which may be formed of a high-strength plate material (e.g., a steel plate), and the shape and size of which are not limited. Optionally, both the first frame body 110 and the second frame body 120 are configured as a square frame structure, such as an approximately rectangular cavity structure that opens in the forward y-direction; in such a manner, the structure is simple and easy to process and manufacture, and particularly easy to realize that the stabilizing device 100, as whole, could be arranged in a left-right symmetrical manner relative to the central plane 109 in the direction of the y-z plane. The first frame body 110 is fixedly mounted over the elevator car 13, and it thereby can move together with the elevator car 13. Of course, the stabilizing device 100 can also transmit acting force to the elevator car 13 through the first frame body 110 during its operation so as to reduce or relieve movement of the stopped elevator car 13 in the z-direction. The size of the second frame body 120 is smaller than that of the first frame body 110, the second frame body 120 can be positioned and installed within the first frame body 110, the first frame body 110 and the second frame body 120 can move upwardly and downwardly relative to each other. The specific examples below will illustrate the up-down movement of each other between the first frame body 110 and the second frame body 120 in the working process.

In an embodiment, the second frame body 120 is mounted within the first frame body 110 in a horizontally limiting manner, so that the second frame body 120 cannot substantially move in the x-direction and the y-direction relative to the first frame body 110; even if the first frame body 110 and the second frame body 120 move upwardly and downwardly relative to each other, the distances between the second frame body 120 and the inner side faces of the first frame body 110 in the x-direction and in the y-direction are substantially kept unchanged, which can play a very important role in improving working reliability, effectiveness and the like of the stabilizing device 100. Specifically, the second frame body 120 is mounted within the first frame body 110 in a limiting manner in a horizontal direction through one or more horizontal fixtures 111, and the horizontal fixture 111 can be specifically one or more anti-skid bolts located between a lower bottom face of the second frame body 120 and a lower bottom face of the first frame body 110. Moreover, when the stopped elevator car 13 moves in the up-down direction, the second frame body 120 can move upwardly and downwardly relative to the first frame body 110 by taking the horizontal fixture 111 as a guide component.

Still referring to FIGS. 1 and 2, the stabilizing device 100 may include a left electromagnetic block 130*a* and a right electromagnetic block 130*b*, may also include a left damper 150*a* and a right damper 150*b* for absorbing energy in the up-down direction, and may further include a left horizontal actuating member 140*a* and a right horizontal actuating member 140*b* corresponding to the left electromagnetic block 130*a* and the right electromagnetic block 130*b*, respectively.

The left electromagnetic block 130*a* and the right electromagnetic block 130*b* are movable in the left-right direction (i.e., the x-direction), which constitute an electromagnetic-block pair for clamping the guide rail 11; when energized by a control portion (not shown in the figures) of the stabilizing device 100, the left electromagnetic block 130*a* and the right electromagnetic block 130*b* will generate a large force that attracts the guide rail 11, thereby clamping the guide rail 11. The left electromagnetic block 130*a* and the right electromagnetic block 130*b* are installed in the second frame body 120 in the limiting manner in the up-down direction and used for clamping the guide rail 11 and generating friction force for preventing the second frame body 120 from moving upwardly and downwardly relative to the clamped guide rail 11. The friction force causes the second frame body 120 to keep substantially static relative to the clamped guide rail 11. The left electromagnetic block 130*a* and the right electromagnetic block 130*b* may be disposed in the second housing 120 in a left-right symmetrical manner along the central plane 109 of the stabilizing device 100. Since installed in the limiting manner in the up-down direction, the left electromagnetic block 130*a* and the right electromagnetic block 130*b* cannot move in the up-down direction, thereby facilitating efficient transmitting of the force of the electromagnetic-block pair 130 relative to the second frame body 120 and the overall stabilizing device 100 in the z-direction. By way of example, the sizes of the left electromagnetic block 130*a*, the right electromagnetic block 130*b* and the second frame body 120 are designed so that the upper and lower ends of the left electromagnetic block 130*a* and the right electromagnetic block 130*b* abut against the upper and lower inner side faces of the second frame body 120 respectively; thus, the left electromagnetic block 130*a* and the right electromagnetic block 130*b* are mounted in a limiting manner in the up-down direction. In other embodiments, the left electromagnetic block 130*a* and the right electromagnetic block 130*b* may also be restricted from moving back and forth in the y-direction by, for example, a guide rail (not shown) on the second frame body 120.

In an embodiment, the left electromagnetic block 130*a* and the right electromagnetic block 130*b* are capable of sliding left and right along a guide rail (not shown in the figures) provided on an inner side surface of the second housing 120, which may be provided on, for example, the upper inner side surface, the lower inner side surface and/or the rear inner side surface of the second housing 120; in such a manner, it is easier to conveniently and reliably achieve the left-right movements of the left electromagnetic block 130*a* and the right electromagnetic block 130*b* within the second frame body 120, and it is also easy to ensure that the working surfaces of the left electromagnetic block 130*a* and the right electromagnetic block 130*b* are substantially parallel to the clamping surfaces of the guide rail 11.

Still referring to FIGS. 1 and 2, the left horizontal actuating member 140*a* can push the left electromagnetic block 130*a* to move towards the rail 11 until the working surface of the left electromagnetic block 130*a* contacts the clamping surface of the rail 11; likewise, the right horizontal actuating member 140*b* can push the right electromagnetic block 130*b* to move towards the rail 11 until the working surface of the right electromagnetic block 130*b* contacts the clamping surface of the rail 11. Optionally, the left horizontal actuating member 140*a* and the right horizontal actuating member 140*b* may also be arranged in a left-right symmetrical manner along the central plane 109 of the stabilizing device 100; the left horizontal actuating member 140*a* and the right horizontal actuating member 140*b* are implemented by selecting same type of actuation components, and can be synchronously controlled by the control portion so as to drive the left electromagnetic block 130*a* and the right electromagnetic block 130*b* to act synchronously. In an embodiment, the left horizontal actuating member 140*a* is disposed between the left electromagnetic block 130*a*, and the left inner side face of the second frame body 120, and the left end of the left horizontal actuating member 140*a* may be fixed on the left inner side face of the second frame body 120; the right horizontal actuating member 140*b* is disposed between the right electromagnetic block 130*b* and the right inner side face of the second frame body 120, and the right end of the right horizontal actuating member 140*b* may be fixed on the right inner side face of the second frame body 120.

In an embodiment, a left horizontal reset component 149*a* and a right horizontal reset component 149*b* may also be provided, respectively, corresponding to the left horizontal actuating member 140*a* and the right horizontal actuating member 140*b*; the left horizontal reset component 149*a* may reset the left electromagnetic block 130*a* clamping the guide rail 11 away from the guide rail 11, and the right horizontal reset component 149*b* may reset the right electromagnetic block 130*b* clamping the guide rail 11 away from the guide rail 11. In such a manner, the left electromagnetic block 130*a* and the right electromagnetic block 130*b* can be automatically reset to initial positions in the x-direction, and the left electromagnetic block 130*a* and the right electromagnetic block 130*b* keep a preset distance with the clamping surface of the guide rail 11 in the x-direction, so that the stabilizing device 100, when not in operation, may not affect normal travelling of the elevator car 13.

In particular, the left horizontal actuating member 140*a* or the right horizontal actuating member 140*b* may include a horizontally disposed leading screw and a motor for driving the leading screw; wherein two ends of the leading screw are connected with the inner side face of the second frame body 120 and the left electromagnetic block 130*a*/the right electromagnetic block 130*b* respectively, and the leading screw can be driven by a micro motor, for example, so that the left electromagnetic block 130*a* or the right electromagnetic block 130*b* is pushed to move towards the guide rail 11. Specifically, the left horizontal reset component 149*a* or the right horizontal reset component 149*b* is also optionally a spring sleeved on the leading screw. In other alternative embodiments, the left horizontal actuating member 140*a* or the right horizontal actuating member 140*b* may also be implemented by, for example, a small sized horizontal-pushing electromagnetic coil, or the like.

Still referring to FIGS. 1 and 2, the left damper 150*a* and the right damper 150*b* arranged in the z-direction are primarily used to absorb vibrational energy of the elevator car 13, each of them having a fixed end 151 mounted in the second frame body 120 in the limiting manner in the up-down direction and a movable end 152 connected to the first frame body 110, such as connected to the first frame body 110 by a link block 1521. Vibration of the first frame body 110 in the z-direction (e.g., the vibration caused by entry and exit of passengers when the elevator car 13 is stopped) can be transmitted to the second frame body 120 via the movable end 152 and the fixed end 151 in sequence, and the electromagnetic-block pair 130 clamping the guide rail 11 will prevent the second frame body 120 from generating the vibration. Since the energy of the vibration of the first frame body 110 can be absorbed by the left damper 150*a* and the right damper 150*b*, thereby the vibration of the first frame body 110 relative to the second frame body 120 in the z-direction is relatively reduced, and the vibration of the elevator car 13 is also reduced or suppressed.

In an embodiment, the stabilizing device 100 further includes a left vertical reset component 159*a* and a right vertical reset component 159*b*, for example, when the electromagnetic-block pair 130 loosens the guide rail 11, the left vertical reset component 159*a* and the right vertical reset component 159*b* can push the fixed ends 151 of the dampers to reset downwards. Therefore, the second frame body 120 is reset in the up-down direction relative to the first frame body 110, and the second frame body 120, inside the first frame body 110, is substantially kept at initial distance(s) in the z-direction with respect to the upper and lower inner side faces of the first frame body 110. The left vertical reset component 159*a* and the right vertical reset component 159*b* can be, in particular, resilient members such as springs.

By way of example, the left damper 150*a* and the right damper 150*b* are hydraulic buffers whose oil cylinders correspond to the fixed ends 151 (e.g., the fixed ends 151 may be oil cylinders 151) and whose piston rods correspond to the movable ends 152 (e.g., the movable ends 152 may be piston rods 152). Correspondingly, the left vertical reset component 159*a*/the right vertical reset component 159*b* can be a resilient element such as a spring sleeved on the piston rod. It will be appreciated that the oil cylinder 151 may be integrally, vertically and fixedly mounted inside the second frame body 120 and may be detachably replaced.

The left damper 150*a* and the right damper 150*b* are arranged in a left-right symmetrical manner along the central plane 109 of the stabilizing device 100, which not only contributes that the first frame body 110 and the second frame body 120 can move upwardly and downwardly in parallel, but also favors to reduce the volume of the left damper 150*a* and the volume of the right damper 150*b* (for example, the required volume of each oil cylinder 151 can be greatly decreased, as compared with the case of using only a single damper), and to reduce the cost of the left damper 150*a* and the right damper 150*b*. Similarly, the left electromagnetic block 130*a* and the right electromagnetic block 130*b* arranged in a left-right symmetrical manner can greatly reduce the volume of the single electromagnetic block (compared with the case that only a single electromagnetic block is arranged to attract and fix the guide rail 11), and can generate large clamping force, and friction force generated with the guide rail 11 is large in the working process. Thus, the volume of the second frame body 120 may be designed to be smaller, and the overall structure not only turns simple but also appears compact, which greatly reduces the volume of the stabilizing device 100, and reduces the cost of the stabilizing device 100.

It should be noted that the left and right dampers 150*a*, 150*b* are not limited to be implemented by the hydraulic buffers exemplified above, which may also be implemented by using other components that may absorb energy in the z-direction. In other alternative embodiments, the left damper 150*a* and the right damper 150*b* may have a bi-directional damping function, for example, the upper and lower ends of the same oil cylinder 151 have an upper piston rod connected to the upper end of the first frame body 110 and a lower piston rod connected to the lower end of the first frame body 110, respectively.

It should be noted that, as shown in FIG. 1, one or more vertical reset components 112 may also be provided in the stabilizing device 100, the vertical reset components 112 may also cause the second frame body 120 to reset in the up-down direction relative to the first frame body 110, and the vertical reset components 112 may be springs, which may be sleeved on the horizontal fixtures 111.

The working principle of the stabilizing device 100 of an embodiment of the present invention is illustrated below in connection with FIGS. 3 and 4.

Figure 3:
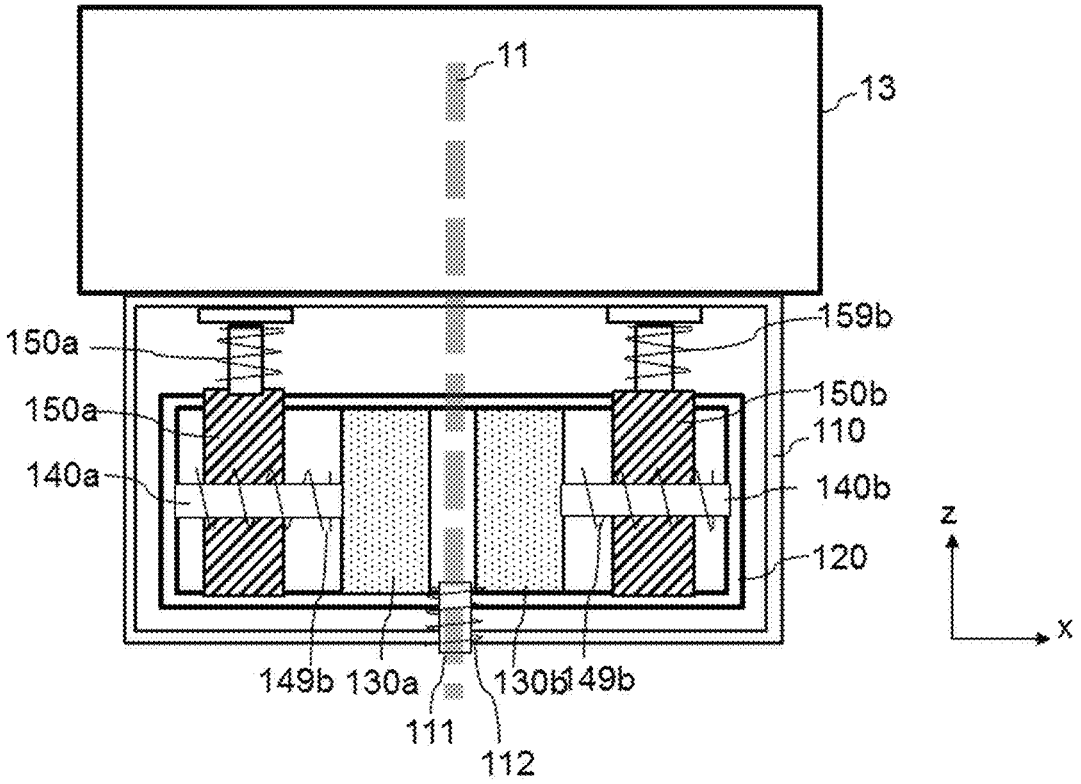
FIG. 3 is a schematic view of an electromagnetic-block pair of the stabilizing device of an elevator car in a clamping guide rail state according to the first embodiment of the present invention.

As shown in FIG. 3, when the elevator system 10 controls the elevator car 13 to stop at a certain landing and before the car door is not opened, the control portion of the stabilizing device 100 firstly controls the left horizontal actuating member 140*a* and the right horizontal actuating member 140*b* (for example, controlling micro motors of the left horizontal actuating member 140*a* and the right horizontal actuating member 140*b*) to push the left electromagnetic block 130*a* and the right electromagnetic block 130*b*, respectively, to get close to the rail 11 until, for example, the working surfaces of the left electromagnetic block 130*a* and the right electromagnetic block 130*b* contact the working surface of the rail 11. The control portion of the stabilizing device 100 then controls the left electromagnetic block 130*a* and the right electromagnetic block 130*b* to be energized or electrified to clamp the guide rail 11 so that the stabilizing device 100 enters a guide rail lamped state (at which the elevator car 13 is still not vibrated, sunk, or floated due to entry and exit of passengers). The control process is achieved step by step, namely the adsorption electromagnet 340 is pushed to get close to and make contact with the guide rail 11 firstly and then is energized to generate the clamping force, which avoids large impact caused by the fact that the left electromagnetic block 130*a* and the right electromagnetic block 130*b* are directly energized to be attracted to the guide rail 11. Thus, the collision and impact generated by the electromagnetic-block pair 130 and the guide rail 11 are small, and the impact sound is small; not only is the service life of the electromagnetic-block pair 130 prolonged, but also passengers are prevented from being interfered by the impact sound.

Figure 4:
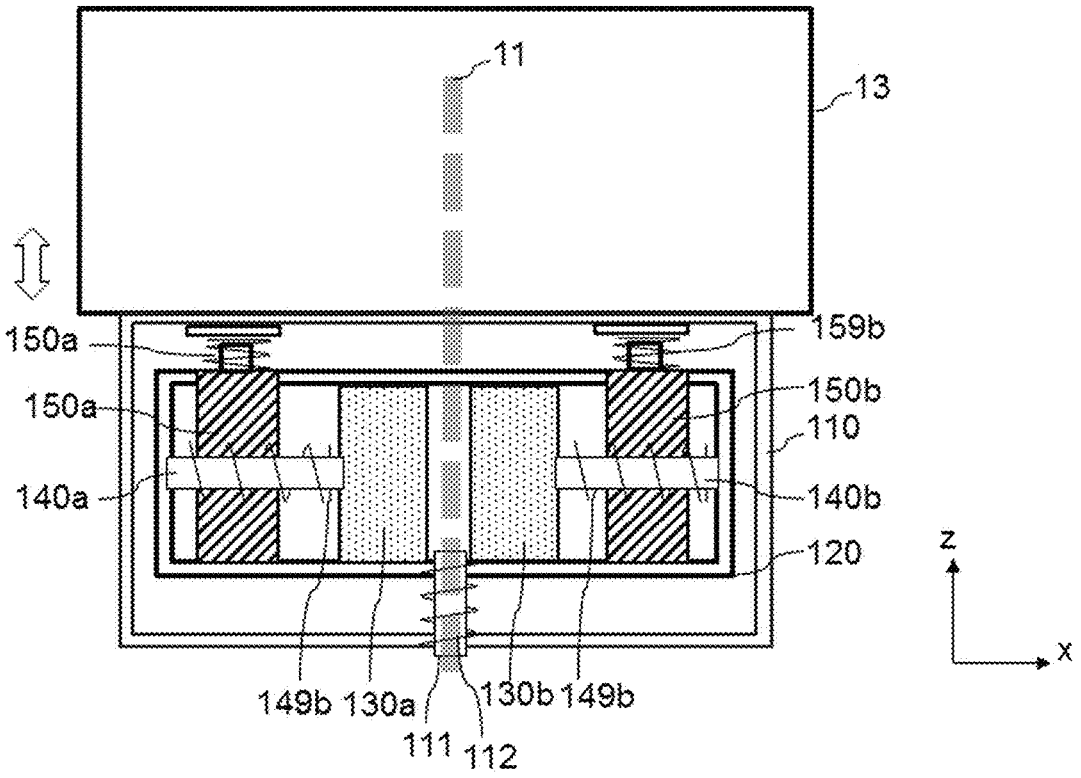
FIG. 4 is a schematic view of the stabilizing device of the elevator car according to the first embodiment of the present invention in a normal working condition.

Further, as shown in FIG. 4, after the car doors of the elevator car 13 are opened, if the elevator car 13 is loaded/unloaded (e.g., enter and exit of passengers, etc.), a change in the weight of the elevator car 13 will cause a certain amount of elastic deformation of the steel belt 14, which, in view of the relatively large elastic deformation of the steel belt 14, will result in a more pronounced vibration in the up-down direction. With downward displacement of the elevator car 13 during this vibration as an example (e.g., passengers entering the car 13), the first frame body 110 will also be displaced downward with the elevator car 13, and the second frame body 120 will also be fixed relative to the guide rail 11 due to the static friction force generated by the electromagnetic-block pair 130 and the guide rail 11 causing the electromagnetic-block pair 130 to be fixed relative to the guide rail 11. At this time, the first frame body 110 moves downward relative to the second frame body 120, and the left damper 150*a* and the right damper 150*b* absorb energy to reduce or slow down the downward movement of the first frame body 110 relative to the second frame body 120, thereby reducing the distance of movement and effectively suppressing the amplitude of vibration/sinking/floating. Similarly, when the elevator car 13 is displaced upward (e.g., passengers exiting the car 13), it is also possible to effectively suppress or reduce actions such as vibration/sinking/floating, etc. generated in the z-direction.

After the loading/unloading of the elevator car 13 is finished, for example, after the car door is closed again, the control portion of the stabilizing device 100 can control the left electromagnetic block 130*a* and the right electromagnetic block 130*b* to be powered off, and the left horizontal reset component 149*a* and the right horizontal reset component 149*b* can automatically pull the left electromagnetic block 130*a* and the right electromagnetic block 130*b* back to the initial positions in the x-direction respectively. The left vertical reset component 159*a*, the right vertical reset component 159*b* and the vertical reset component 112 can automatically reset the second frame body 120 to the initial position in the z-direction within the first frame body 110, so that the reset operation is automatically completed, and preparation is made for the next operation of the stabilizing device 100.

It should be understood that the electromagnetic-block pair 130, the damper pair and other main components of the stabilizing device 100 of the above embodiment are all positioned and mounted in the second frame body 120 in a left-right symmetry manner, the overall internal structure is simple and compact, the volume is small, and can be achieved in low cost.

It should be noted that, in the vibration action of the stopped elevator car, it may also be accompanied by a sinking or floating action of the elevator car in the up-down direction. The movement of the elevator car to be prevented or overcome by the stabilizing device 100 may be caused by various reasons, and it is not limited to being due to elastic deformation of the traction medium.

In the foregoing, a "steel belt" is a component used at least to drag the elevator car, which has a width value in a first direction greater than a thickness value in a second direction in its cross-section perpendicular to the length direction, wherein the second direction is substantially perpendicular to the first direction.

Various stabilizing devices of the present invention and elevator system using the stabilizing devices are mainly illustrated above with above examples. Although only some of implementations of the present invention are described, those of ordinary skill in the art should understand that the present invention can be implemented in many other forms without departing from the substance and scope of the present invention. Therefore, the shown examples and implementations are regarded as illustrative rather than limitative, and the present invention may cover various modifications and replacements without departing from the spirit and scope of the present invention as defined in the appended claims.

What is claimed is:

1. A stabilizing device (100) of an elevator car, including:

a first frame body (110) fixedly mounted relative to the elevator car (13);

a second frame body (120) positioned and mounted within the first frame body (110), wherein the first frame body (110) and the second frame body (120) are moveable upwardly and downwardly relative to each other;

a left electromagnetic block (130*a*) and a right electromagnetic block (130*b*), which are installed in the second frame body (120) in a limiting manner in an up-down direction, for clamping a guide rail (11) and generating friction force for preventing the second frame body (120) from moving up and down relative to the clamped guide rail (11); and a left damper (150*a*) and a right damper (150*b*) arranged along the up-down direction, whose fixed ends (151) are mounted within the second frame body (120) in a limiting manner in the up-down direction, and whose movable ends (152) are connected to the first frame body (110) and moveable upwardly and downwardly together with the first frame body (110) under the condition that the guide rail (11) is clamped by the left electromagnetic block (130*a*) and the right electromagnetic block (130*b*), so as to reduce movement of the elevator car in the up-down direction;

wherein when electrified, the left electromagnetic block (130*a*) and the right electromagnetic block (130*b*) generate a force that attracts the guide rail (11), thereby clamping the guide rail.

2. The stabilizing device (100) according to claim 1, wherein the left electromagnetic block (130*a*) and the right electromagnetic block (130*b*) are arranged in a left-right symmetrical manner along a central plane (109) of the stabilizing device (100), and the left damper (150*a*) and the right damper (150*b*) are arranged in a left-right symmetrical manner along the central plane (109) of the stabilizing device (100).

3. The stabilizing device (100) according to claim 1, further including:

a left horizontal actuating member (140*a*) for pushing the left electromagnetic block (130*a*) towards the guide rail (11); and a right horizontal actuating member (140*b*) for pushing the right electromagnetic block (130*b*) towards the guide rail (11);

wherein the left horizontal actuating member (140*a*) and the right horizontal actuating member (140*b*) are mounted within the second frame body (120).

4. The stabilizing device (100) according to claim 3, wherein the left horizontal actuating member (140*a*) and the right horizontal actuating member (140*b*) are arranged in a left-right symmetrical manner along a central plane (109) of the stabilizing device (100).

5. The stabilizing device (100) according to claim 3, further including a control portion configured to:

firstly control, when the elevator car (13) stops moving, the left horizontal actuating member (140*a*) and the right horizontal actuating member (140*b*) to push the left electromagnetic block (130*a*) and the right electromagnetic block (130*b*), respectively, to get close to the guide rail (11); and then control, when both the left electromagnetic block (130*a*) and the right electromagnetic block (130*b*) substantially contact with the guide rail (11), the left electromagnetic block (130*a*) and the right electromagnetic block (130*b*) to be energized electrified to clamp the guide rail (11).

6. The stabilizing device (100) according to claim 3, further including:

a left horizontal reset component (149*a*) for resetting the left electromagnetic block (130*a*) clamping the guide rail (11) away from the guide rail (11); and a right horizontal reset component (149*b*) for resetting the right electromagnetic block (130*b*) clamping the guide rail (11) away from the guide rail (11).

7. The stabilizing device (100) according to claim 3, wherein the left horizontal actuating member (140*a*)/the right horizontal actuating member (140*b*) comprises a horizontally disposed leading screw and a motor for driving the leading screw; wherein two ends of the leading screw are connected with the inner side face of the second frame body (120) and the left electromagnetic block (130*a*)/the right electromagnetic block (130*b*) respectively, and the left horizontal reset component (149*a*)/the right horizontal reset component (149*b*) is a spring sleeved on the leading screw.

8. The stabilizing device (100) according to claim 1, wherein the left electromagnetic block (130*a*) and the right electromagnetic block (130*b*) are capable of sliding left and right on a guide rail provided inside the second frame body (120).

9. The stabilizing device (100) according to claim 1, further including:

a left vertical reset component (159*a*) and a right vertical reset component (159*b*) for resetting the second frame body (120) relative to the first frame body (110) in the up-down direction.

10. The stabilizing device (100) according to claim 9, wherein the left damper (150*a*)/the right damper (150*b*) is a hydraulic buffer, an oil cylinder of the hydraulic buffer corresponds to the fixed end (151), and a piston rod of the hydraulic buffer corresponds to the movable end (152).

11. The stabilizing device (100) according to claim 10, wherein the left vertical reset component (159*a*)/the right vertical reset component (159*b*) is a spring sleeved on the piston rod.

12. The stabilizing device (100) according to claim 1, wherein the second frame body (120) is mounted within the first frame body (110) in a limiting manner in a horizontal direction by means of a horizontal fixture (111); and, when the elevator car (13) moves in the up-down direction, the second frame body (120) is moveable upwardly and downwardly relative to the first frame body (110) by taking the horizontal fixture (111) as a guide component.

13. The stabilizing device (100) according to claim 1, further including a third vertical reset component (112) for resetting the second frame body (120) relative to the first frame body (110) in the up-down direction.

14. The stabilizing device (100) according to claim 1, wherein the second frame body (120) is approximately a square frame structure.

15. The stabilizing device (100) according to claim 1, wherein the first frame body (110) is approximately a square frame structure and the second frame body (120) is nested in an inner cavity of the first frame body (110).

16. An elevator system (10) including a traction medium (14), an elevator car (13) and a guide rail (11), further including the stabilizing device (100) according to claim 1.

17. A stabilizing device (100) of an elevator car, including:

a first frame body (110) fixedly mounted relative to the elevator car (13);

a second frame body (120) positioned and mounted within the first frame body (110), wherein the first frame body (110) and the second frame body (120) are moveable upwardly and downwardly relative to each other;

a left electromagnetic block (130*a*) and a right electromagnetic block (130*b*), which are installed in the second frame body (120) in a limiting manner in an up-down direction, for clamping a guide rail (11) and generating friction force for preventing the second frame body (120) from moving up and down relative to the clamped guide rail (11); and a left damper (150*a*) and a right damper (150*b*) arranged along the up-down direction, whose fixed ends (151) are mounted within the second frame body (120) in a limiting manner in the up-down direction, and whose movable ends (152) are connected to the first frame body (110) and moveable upwardly and downwardly together with the first frame body (110) under the condition that the guide rail (11) is clamped by the left electromagnetic block (130*a*) and the right electromagnetic block (130*b*), so as to reduce movement of the elevator car in the up-down direction;

wherein the upper and lower ends of the left electromagnetic block (130*a*)/the right electromagnetic block (130*b*) abut against the upper and lower inner side faces of the second frame body (120), respectively.

* * * * *